United States Patent [19]

Lane

[11] Patent Number: 4,853,658

[45] Date of Patent: Aug. 1, 1989

[54] MICROWAVE PHASE SHIFTERS

[75] Inventor: Anthony A. Lane, Northampton, England

[73] Assignee: Plessey Overseas Limited, Ilford, England

[21] Appl. No.: 211,705

[22] Filed: Jun. 27, 1988

[30] Foreign Application Priority Data

Aug. 6, 1987 [GB] United Kingdom ..... 8718651

[51] Int. Cl.[4] ..... H01P 9/00; H01P 1/18; H01P 5/04

[52] U.S. Cl. ..... 333/164; 333/156; 333/160

[58] Field of Search ..... 333/156, 157, 160, 164, 333/161, 138–139, 23; 307/262, 571; 328/55–57

[56] References Cited

U.S. PATENT DOCUMENTS 4,161,705 7/1979 Nemit et al. ..... 333/164
4,647,789 3/1987 Upadhyayula ..... 333/164 X

FOREIGN PATENT DOCUMENTS 0041812 3/1985 Japan ..... 333/164

*Primary Examiner*—Marvin L. Nussbaum
*Attorney, Agent, or Firm*—Fleit, Jacobson, Cohn, Price, Holman & Stern

[57] ABSTRACT

The invention provides a phase-shifting device for inclusion into a microwave transmission line to effect a predetermined, constant, broadband shift in phase of transmitted signals. The device comprises, in its preferred form, two Gallium Arsenide field effect transistors, connected in parallel, serially included in the line, and means for switching the transistors between alternate states to effect the phase shift.

5 Claims, 3 Drawing Sheets

MICROWAVE PHASE SHIFTERS

This invention relates to microwave phase shifting devices and to transmission lines including such devices.

Difficulties are experienced in introducing controlled small e.g. less than 10° constant phase shifts in transmitted microwave signals (of frequency greater than 1GHz). Present microwave switched filter networks suffer from parasitic inductances and capacitances in the components thereof making the attainment of a controlled small, constant phase shift difficult and/or of narrow bandwidth and/or very expensive.

It is an object of the present invention to provide a device which utilises the parasitic factors in achieving a controlled, substantially constant, broad bandwidth phase shift for microwave signals.

It is known to provide a transmission line, for transmitting microwave signals in which it is desired to produce a predetermined substantially constant phase shift, comprising a Gallium Arsenide Field Effect Transistor serially included in the line, a first section of the line terminating at the source electrode of the transistor and a second section of the line originating at the drain electrode of the transistor and control means for applying a potential to the gate electrode to switch the transistor on or off, as required, to introduce the shift of phase in a transmitted microwave signal.

According to the present invention, there is provided a phase shifting device, for serial inclusion in a microwave transmission line, the device comprising a pair of disimilar Gallium Arsenide Field Effect Transistors, each having its source connected to the source of the other transistor to form a first terminal of the device and its drain connected to the drain of the other transistor to form a second terminal of the device, and the gates of the transistor being brought out separately so that each transistor may be switched on independantly of the other.

The invention will be described further, by way of example, with reference to the accompanying drawings, in which.

Figure 1:
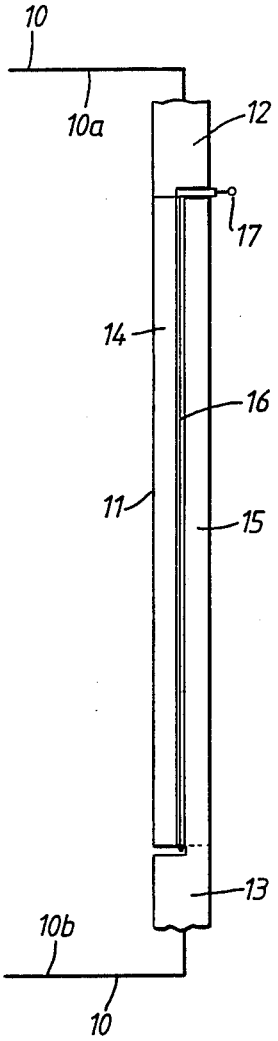
FIG. 1. PRIOR ART
FIG. 1 is a diagrammatic representation of a transmission line including a phase shifting device, as known in the prior art.

Referring to the drawings, FIG. 1 shows a microwave transmission line 10 interrupted for the known serial inclusion therein of a phase-shifting device 11. The device 11, shown diagrammatically in FIG. 1, has terminals 12, 13 for connection respectively to sections 10*a* and 10*b* of the line 10. The device 11 is a GaAs (Gallium Arsenide) FET (Field Effective Transistor). The terminal 12 is electrically connected to the source electrode 14 of the device 11, and the terminal 13 is electrically connected to the drain electrode 15 of device 11. A gate electrode 16 of the device 11 is brought out to a terminal 17 whereto a source of potential (not shown) may be connected to turn the device on.

It will be noted that the device 11 is elongate so as to ensure a relatively large inter-electrode capacitance when the device 11 is turned off and a low channel resistance when the device 11 is turned on.

The capacitance and resistance can be measured for the device in its two states. Additionally, there will be stray capacitances and stray inductances but these will remain substantially constant when the device has been included in a transmission line.

If a microwave transmission is effected along the line 10 with the device turned on, and thereafter the device is turned off by removing the potential applied to the gate 16, a predeterminable phase shift will occur in the transmitted microwave signals. Similarly, when the device is turned on after having been turned off, the phase relationship of the microwave signals is restored to its former value.

Such a device can be used in transmission lines wherealong microwave signals (of frequency >1GHz) are transmitted with a phase shift of the order of less than 10°. However, the use of a single device 11 is disadvantageous as, although a phase shift is achieved, it is only achieved at the expense of what may be an unacceptable power loss.

Figure 2:
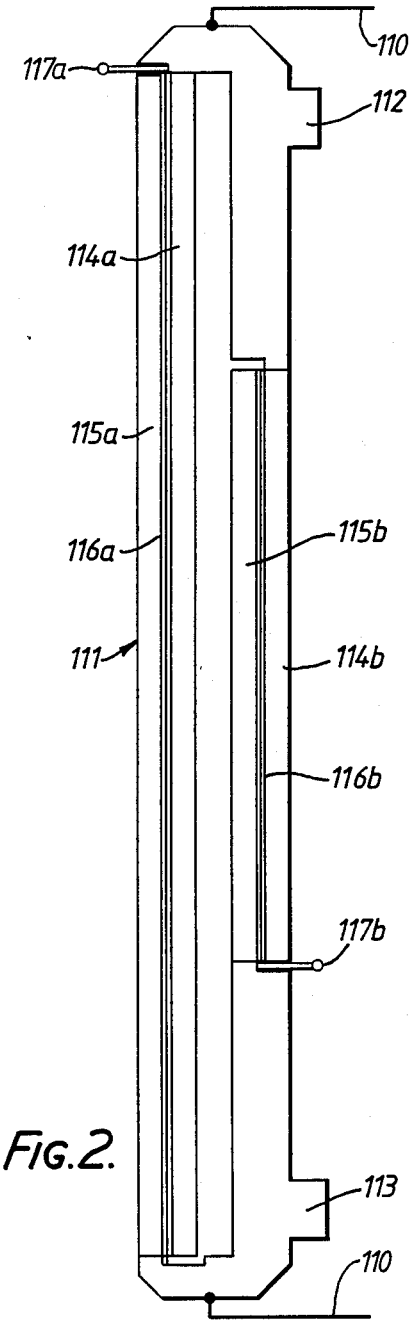
FIG. 2 is a diagrammatic representation of a phase shifting device in accordance with the present invention.

This power loss disadvantage can be overcome, in accordance with the present invention, by the use of a phase shifting device as shown in FIG. 2. The device 111 has terminals 112 and 113 for connection serially in a microwave transmission line 110.

The device 111 comprises two parallelly connected GaAs FETs. The terminal 112 is electrically connected to the source electrode 114*a* of a first of the transistors and to the source electrode 114*b* of the second transistor. Similarly, the terminal 113 is electrically connected to the drain electrode 115*a* of the first transistor and to the drain electrode 115*b* of the second transistor.

The respective gate electrodes 116*a* and 116*b* are brought out to respective external points 117*a* and 117*b* to enable a source of potential to be connected to either of the gates to switch on the respective transistor.

Figure 3:
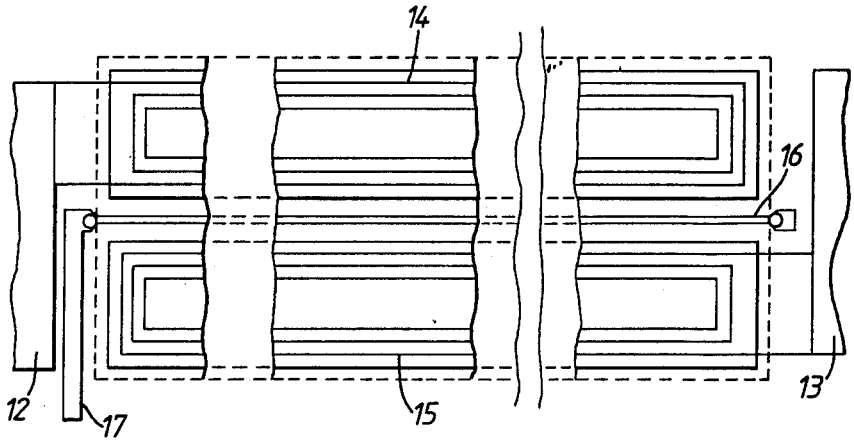
FIG. 3 and 4 are respectively plan and cross-sectional representations of a Gallium Arsenide Field Effect Transistor for insertion in a microwave transmission line whereby to effect a phase shift, in accordance with the present invention.
Figure 4:
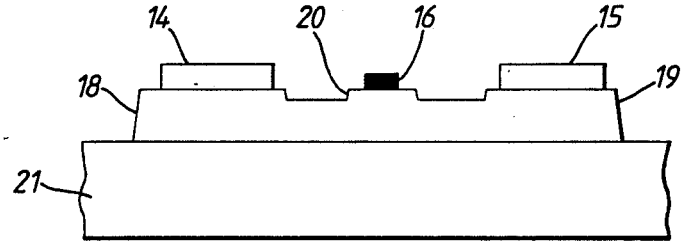

FIGS. 3 and 4 of the drawings illustrate in more detail and to an enlarged scale, the form taken by each of the transistors. The source and drain contacts 14 and 15 are laid upon respective active mesa regions 18, 19 of a GaAs substrate 21. A gate electrode 16 is interposed between the electrodes 14 and 15 on a mesa region 20. The two transistors of the device may be simultaneously formed on the same substrate.

As can be seen particularly on FIG. 3, the source and drain regions 18, 19 and the gate region 20 are elongate, that is, the length of each of these regions is a multiple of the width (seen in FIG. 4). In this way, by variation during manufacture of this multiple, the effective inter-electrode capacitance (when switched off) and the inter-electrode resistance (when switched on) can be predetermined with reasonable accuracy.

Referring back to FIG. 2, it will be seen that the lengths of the two transistors differ by approximately a factor of two and their characteristics capacitances and resistances will therefore differ.

Referring to FIGS. 5*a* to 5*d*, the equivalent circuits of the device of FIG. 2 are diagrammatically illustrated for the four states available.

Figure 5A:
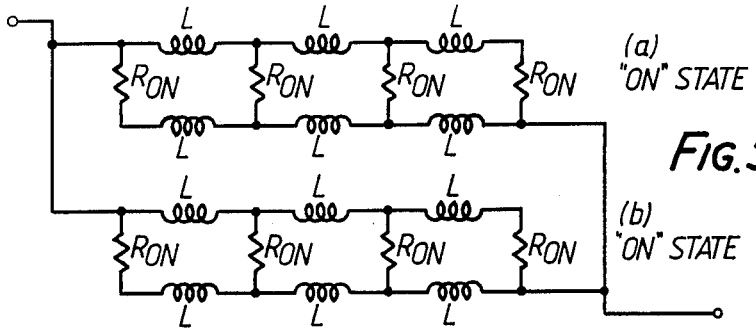
FIGS. 5*a* to *d* are diagrammatic representations of the equivalent circuit of the phase shifting device of the present invention.
Figure 5B:
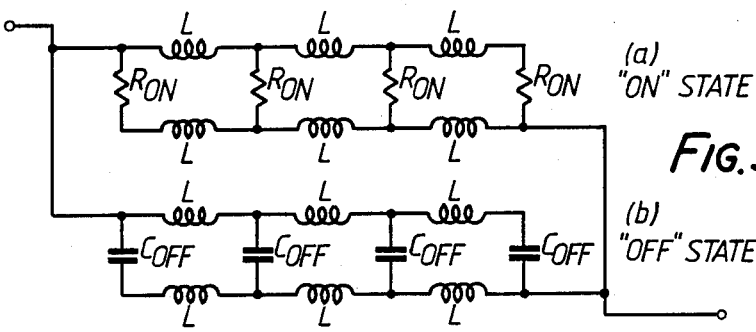
Figure 5C:
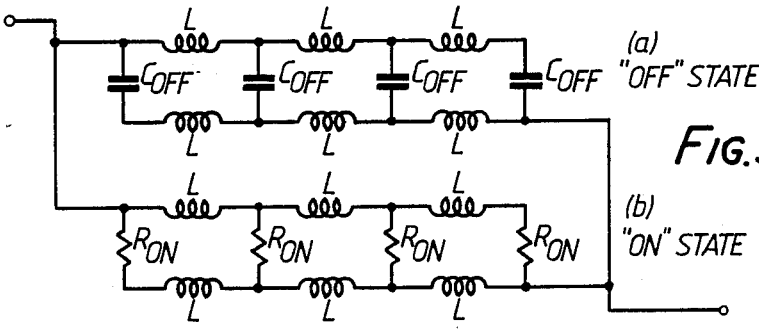
Figure 5D:
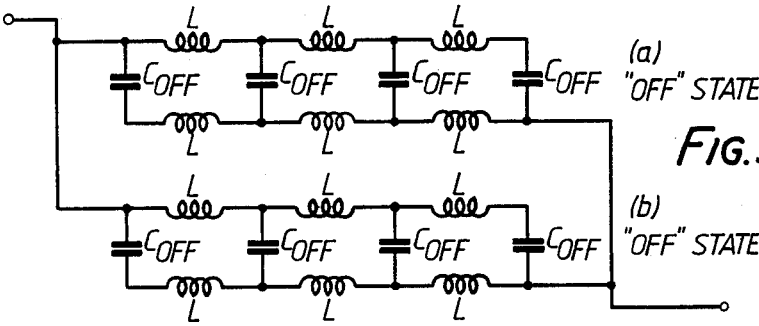

FIGS. 5*a* and 5*d* show the "both transistors on" and the "both transistors off" states where a phase sihft is achieved in a microwave transmission between the two states. As the transistors are in parallel, they act as a single device and hence also have the disadvantage of power loss associated therewith as in the case of the prior art device of FIG. 1.

The preferred mode of operation is illustrated in FIGS. 5*b* and 5*c* where one of the transistors is switched on whilst the other is switched off and the state is reversed to one where the first transistor is switched off and the second transistor is switched on. When this second transistor is switched on, a substantially constant, broadband phase shift is achieved in a microwave signal transmitted along a transmission line including the device and with a very low power loss (for example, of the order of 0.5db). The original phase relationship can be restored by switching the transistors back to their original states.

The invention is not confined to the precise details of the foregoing examples and variations may be made thereto. For instance, in the device of FIG. 2, the two transistors may be separately formed.

Appropriate control means are provided (though not shown) for switching between the states illustrated by the equivalent circuits diagrammatically shown in FIGS. 5*b* and 5*c*.

The device, in its preferred form, is capable of introducing a phase shift of the order of 5° in a microwave transmission having a bandwidth extending from 4 to 7 GHz. Where the microwave signals are of even higher frequency, an appropriate device, in accordance with the present invention, could effect phase shifts in excess of 20°.

What is claimed is:

1. A transmission line, for transmitting microwave signals in which it is desired to produce a predetermined substantially constant phase shift, comprising two Gallium Arsenide Field Effect Transistor, in parallel, serially included in the line, a first section of the line terminating at the source electrodes of the two transistors and a second section of the line originating at the drain electrodes of the two transistors, and control means for applying a potential to the gate electrode of the first or the second transistor to switch the transistor on or off, as required, to introduce a shift of phase in a transmitted microwave signal.

2. A transmission line as claimed in claim 1 wherein the physical dimension of the two transistors are dissimilar.

3. A transmission line as claimed in claim 1 wherein each transistor comprises source, drain and gate electrodes on respective active mesa regions of a common Gallium Arsenide substrate.

4. A phase shifting device for serial inclusion in a microwave transmission line, the device comprising a pair of disimilar Gallium Arsenide Field Effect Transistors, each having its source connected to the source of the other transistor to form a first terminal of the device and its drain connected to the drain of the other transistor to form a second terminal of the device, and the gates of the transistor being brought out separately so that each transistor may be switched on independantly of the other.

5. A device as claimed in claim 4 further including control means for applying a potential to only one of the gates to switch on the respective transistor.

* * * * *